US010068509B2

(12) United States Patent
Fletcher et al.

(10) Patent No.: US 10,068,509 B2
(45) Date of Patent: Sep. 4, 2018

(54) FAULT DETECTION FOR A DISPLAY SYSTEM

(71) Applicant: L-3 COMMUNICATIONS CORPORATION, New York, NY (US)

(72) Inventors: Mark Fletcher, Cumming, GA (US); Ronald Christian, Alpharetta, GA (US); William Cumby, Johns Creek, GA (US)

(73) Assignee: L-3 COMMUNICATIONS CORPORATION, New York, NY (US)

( * ) Notice: Subject to any disclaimer, the term of this patent is extended or adjusted under 35 U.S.C. 154(b) by 24 days.

(21) Appl. No.: 15/058,725

(22) Filed: Mar. 2, 2016

(65) Prior Publication Data

US 2017/0255504 A1 Sep. 7, 2017

(51) Int. Cl.
*G06G 3/00* (2006.01)
*G09G 3/00* (2006.01)

(52) U.S. Cl.
CPC ..... *G09G 3/006* (2013.01); *G09G 2330/08* (2013.01); *G09G 2330/12* (2013.01)

(58) Field of Classification Search
CPC ..... G09G 3/006; G09G 2330/08–2330/12
USPC ..... 714/5.1; 345/904
See application file for complete search history.

(56) References Cited

U.S. PATENT DOCUMENTS 7,243,291 B1 * 7/2007 Williams ..... G09G 5/006 714/758
7,295,179 B2 11/2007 Dunn
7,724,259 B2 * 5/2010 Hedrick ..... G01C 23/00 345/501
7,728,788 B1 6/2010 Echols
8,788,890 B2 * 7/2014 Kim ..... G09G 3/006 714/704
2014/0068374 A1 * 3/2014 Ha ..... H03M 13/2909 714/755
2017/0094268 A1 * 3/2017 Gulati ..... G09G 3/006

OTHER PUBLICATIONS

U.S. Appl. No. 14/963,880 for "Fault-Tolerant AMLCD Display" filed Dec. 9, 2015.

* cited by examiner

*Primary Examiner* — Joseph R Kudirka
(74) *Attorney, Agent, or Firm* — Dickinson Wright PLLC

(57) ABSTRACT

A fault detection system is provided for a display system including an AMLCD. A video processor embeds encoded fault detection data within the digital video stream that is sent directly to the AMLCD. The fault detection data is embedded in such a manner that it is not displayed by the AMLCD. The fault detection data in the digital video stream received by the AMLCD is detected by the AMLCD and is then sent back to the video processor. The video processor compares what was sent with what is received to determine whether there is a difference which may be indicative of a fault in the AMLCD or the path of the digital video stream. As an additional check, the AMLCD may send timing error data to the video processor indicating whether the AMLCD is working properly. The video processor generates and outputs a fault flag to initiate a corrective action if a fault is detected in the AMLCD and/or the path of the digital video stream.

21 Claims, 3 Drawing Sheets

FAULT DETECTION FOR A DISPLAY SYSTEM

BACKGROUND

Fault-tolerant large area Active Matrix Liquid Crystal Displays (AMLCDs) are useful for flight-critical, primary aircraft cockpit displays where safety and high reliability are of the utmost importance for both military and commercial aircraft platforms. However, the desired fault tolerance presents significant challenges.

U.S. Pat. Nos. 7,295,179 and 7,728,788 both present possible approaches to fault tolerance through simple redundancy. U.S. Pat. No. 7,295,179 describes a liquid crystal display with two identical but totally electrically isolated left and right side displays residing on one single glass substrate. Under this arrangement, if a fault occurs in one side of the composite display (in one of the displays), the other side will still be operational. Thus, in this arrangement, the two displays can be driven to appear as one display and if one of the displays fails, the failing display is simply turned off and the other display continues (but with now only half of the total display area of the two displays working together). So in essence, a fault in the left or right (or top or bottom) portion of the composite display can be isolated to the left or the right (or top or bottom) portion and does not render the entire display unusable.

The approach put forward in U.S. Pat. No. 7,728,788 partitions the liquid crystal display into multiple sections which are driven by independent sources. Fault tolerance is achieved somewhat in that if one section fails, the remaining section(s) can remain operational.

Unfortunately, if a fault occurs in the above solutions, typically there will some amount of the original (display) information lost, even though the display system might yet still display enough information for the flight crew to return home safely.

Moreover, military and commercial aircraft cockpit displays often incorporate many fault detection capabilities which may trigger actions within a fault tolerant system in an attempt to mitigate the effects of the fault, thereby improving the overall reliability of the system. However, in the case of a display system where a fault occurs within the Active Matrix Liquid Crystal Display (AMLCD) itself or within its associated video path to the AMLCD, then that fault is usually only detectable by a visual inspection of the display by the operator, if at all.

SUMMARY OF THE INVENTION

Briefly described, the present invention relates to fault detection in display systems, such as those often used in demanding applications like aircraft and military displays. A fault detection system is provided which detects faults in the path of the digital video stream being fed to the display, e.g., frozen, stale, or corrupted data being fed to the display, or faults in the actual display which may result in loss of the display image. System fault tolerant mitigation circuitry may then take corrective action without the need for operator intervention (or without the operator being required to note, as a threshold matter, that a fault had occurred). Such a method of performing a health check on a display system, such as an AMLCD, and its associated video path without the need for operator intervention is useful for high-reliability primary cockpit displays where fault tolerant systems can enable the pilot to return home safely or even continue with a mission in the event of a failure of a video path to the AMLCD or within the AMLCD itself. Such can also prevent the presentation of misleading or invalid information to the pilot or operator.

In one preferred form, the present invention provides fault detection in that a video processor embeds an encoded carryover pixel (COP) within the digital video stream that is sent directly to the AMLCD. Preferably, the COP data is embedded in a blanking period within the video stream in such a manner that it is not visible on the display. The encoded COP data is changed for every frame of video such that it is unique for each video frame of a video stream. The COP preferably is detected by the timing and control unit of the AMLCD and is then sent back to the video processor where a comparison is made between what was sent and what was received. If the sequence of COP data encoded across multiple video frames matches the detected sequence of COP data, then there is a high degree of certainty that video path is good, and no stale video data is being presented on the display. If the data is found to be corrupt, or even missing, then fault tolerant circuitry may take action to mitigate the fault, such as by switching to another video source.

In another preferred form, the present invention provides fault detection in that the timing and control unit of the AMLCD compares a start pulse sent to cascaded shift registers of the AMLCD with a return pulse received from the end of the final shift register in the cascade. The digital video data stream takes a certain amount of time to pass through the registers, and the timing and control unit expects to receive the return pulse at a certain time. If the shift registers are working properly, the return pulse will be received at the expected time. If the return pulse is received at the expected time, then the shift registers are performing properly, and the timing and control unit sets a PASS bit. If the return pulse is not received at the expected time, then there is a fault in the shift registers, and the timing and control unit sets a FAIL bit. The bit set by the timing and control unit is then sent back to the video processor where a determination is made whether the bit is a PASS bit or a FAIL bit. If the bit is a PASS bit, then there is a high degree of certainty that the AMLCD is working properly If the bit is a FAIL bit, then fault tolerant circuitry may take action to mitigate the fault, such as by switching to a known good (still healthy) display In another preferred form, both the COP encoding and the PASS/FAIL bit may be used to check the performance of the AMLCD and the associated digital video path. If there is a mismatch in the encoded COPs sent to the AMLCD and the detected COPs and/or the received timing error control bit is a FAIL bit, then fault tolerant circuitry may take action to mitigate the fault, such as by switching to a known good display and/or to another video source.

BRIEF DESCRIPTION OF THE DRAWING FIGURES

DETAILED DESCRIPTION

Figure 1:
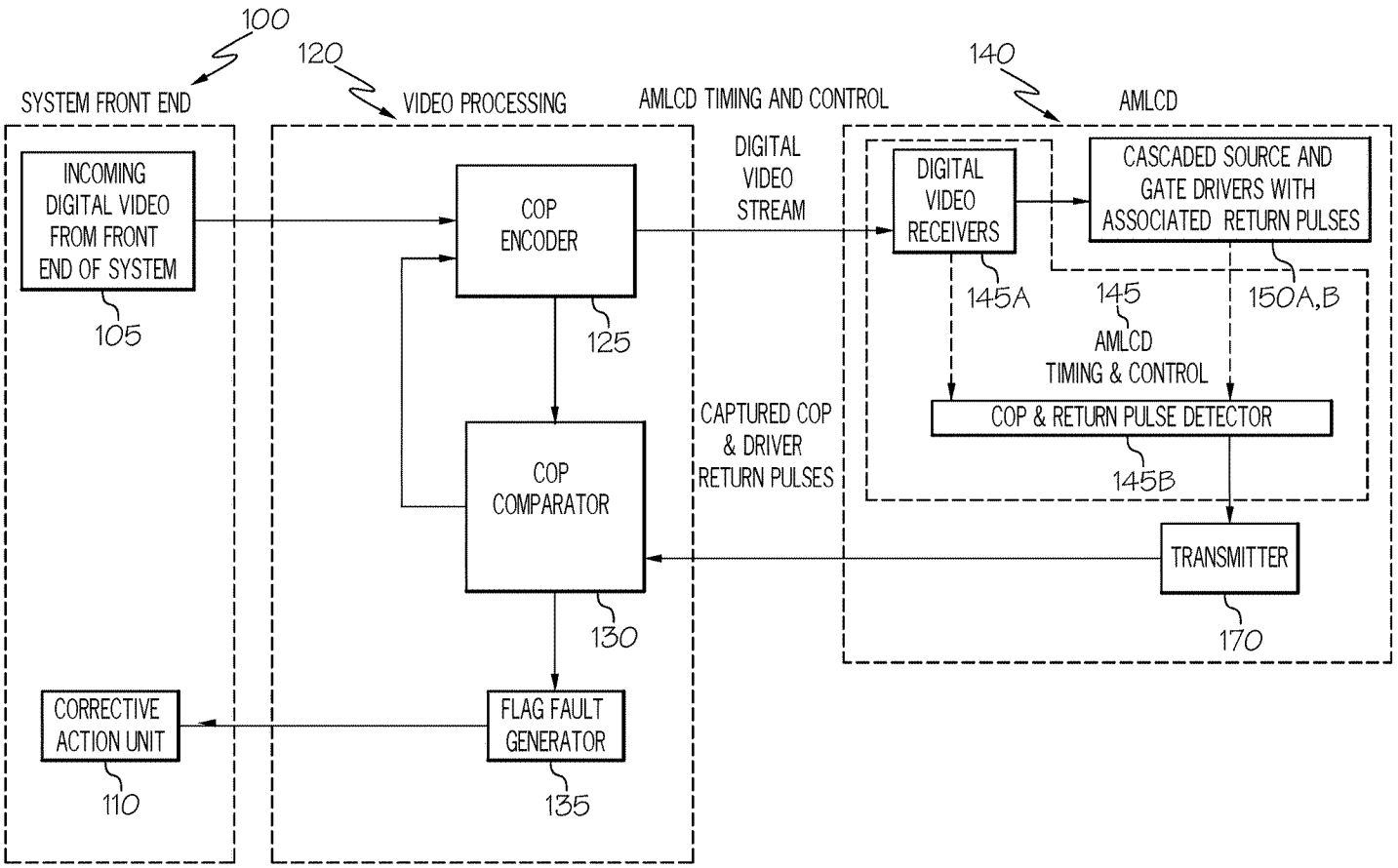
FIG. 1 illustrates a display system including fault detection components according to an illustrative embodiment.

Referring to FIG. 1, a fault detection system is incorporated in a display system including a system front end 100, a video processor 120, and a display, such an Active Matrix Liquid Crystal Display (AMLCD) 140.

The system front end 100 includes a digital video stream generator 105 which generates digital video frames to be displayed by the AMLCD 140. The generated digital video frames are output as a stream to an encoder 125 which encodes fault detection data, preferably COP data, and embeds the encoded COP data into a portion of the digital video stream which is not intended for display, e.g., the last line of a frame or the first line of a frame. This portion of the frame may be considered a "blanking period". The COP data may be considered "Imaginary" pixel data as it is not intended to actually be displayed. The COP data is encoded in such a manner that it is unique to the frame into which it is embedded, i.e., the COP data changes for each frame, at least within a given stream of video frames, and is also self-synchronizing. Various methods may be used to encode the COP data into consecutive video frames in a sequential manner, such as pseudorandom binary sequence (PRBS) encoding or a similar method.

To aid in the understanding of how the COP data is encoded, it is helpful to understand the arrangement of pixels and subpixels in a display system. Pixels consist of three sub-pixels (red green blue). Each sub-pixel may be assigned a specific brightness level (or more accurately liquid crystal transparency). If, for example, an AMLCD has source drivers that can drive 8 bits of data for each color (8 for red, 8 for green 8 for blue) then it is said to have a color depth of 256 ($2^8$=256). With each color having 256 possible levels or shades, then each pixel can be one of any +16 million colors. When the imaginary COP data is encoded using PRBS, each of the sub-pixels can be encoded with levels from 0 to 255.

The digital video stream, with the encoded COP data embedded, is output to the AMLCD 140. The digital video stream may be output using any suitable serial bus interface and communication protocol, e.g., a Low Voltage Video Differential Signal (LVDS) interface, a Mobile Industry Processor Interface (MIPI), a panel link, or a display port. The digital video stream is received by digital video receivers 145A of timing and control unit 145 of the AMLCD 140. The timing and control unit also includes a COP & return pulse detector unit 145B that detects the COP data contained in the blanking period, e.g., in the last line of the video frame, and delivers the video frame to shift registers 150A and 150B for display (as explained in more detail with reference to FIG. 2 below). Additional AMLCD fault coverage is achieved by the detection of return pluses from shift registers 150A and B by detector unit 145B. The detector 145B transfers captured COP data and detected return pulse Pass/Fail data to a transmitter 170 which sends the data back to the video processor 120.

Figure 2:
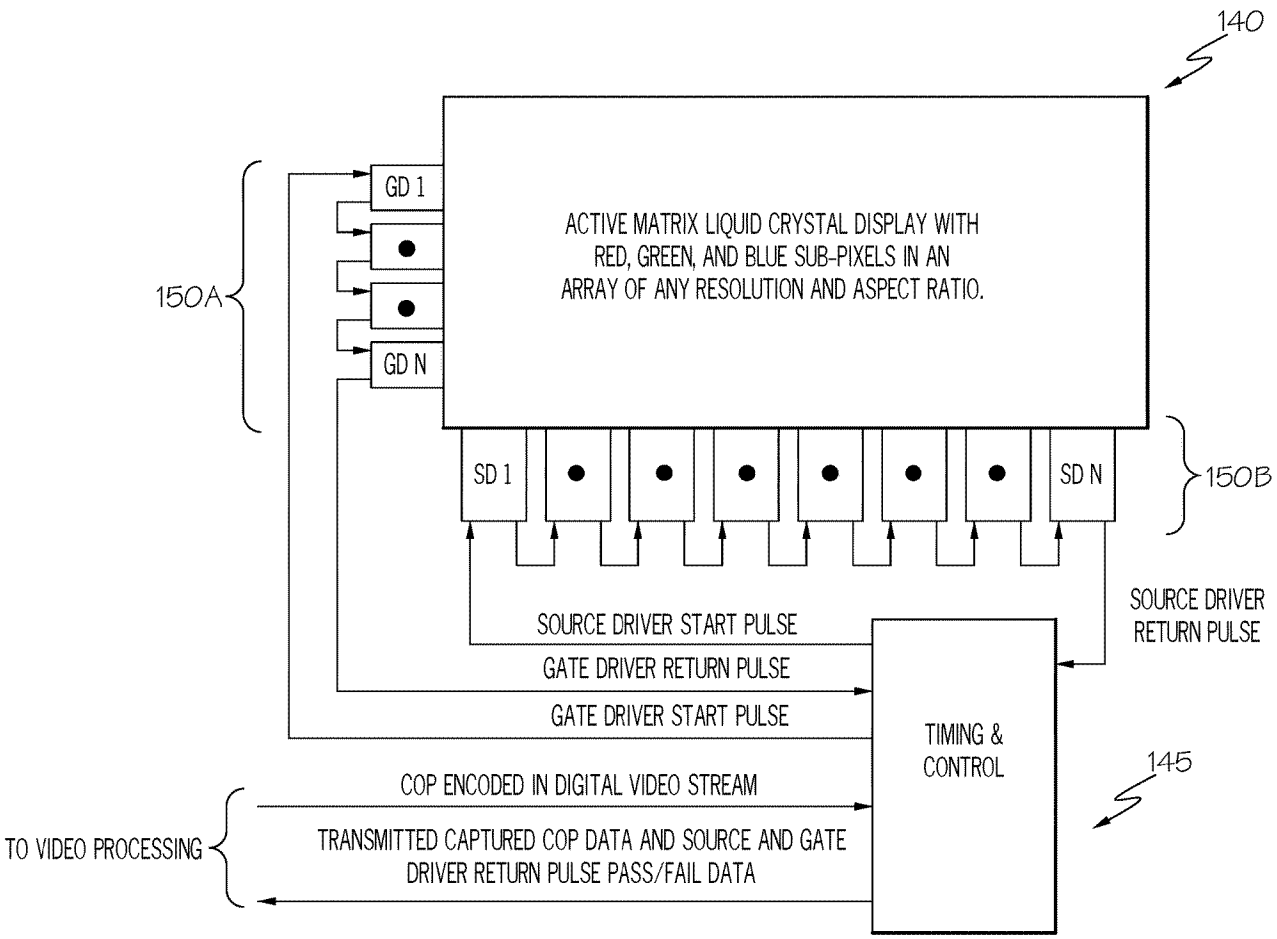
FIG. 2 illustrates details of components of an AMLCD according to an illustrative embodiment.

Referring to FIG. 2, which shows the display system 140 in detail, N gate drivers (GD) 150A and N source drivers (SD) 150B contain cascaded shift registers that shift incoming video data in series through the AMLCD 140. The data goes in one end and out the other for serial to parallel conversion. The more gate and source drivers that are cascaded together, the larger the serial to parallel conversion.

Start pulses are generated by the timing and control unit 145. The start pulses may be generated for each line, for each frame, or for any number of lines/frames. The start pulse is sent through the gate driver GD1 and the source driver SD 1 of the first shift register. If the shift registers are working properly, a return pulse is detected at the end of the cascaded chain of registers at a certain time, e.g., the number of clock cycles it takes to shift a line/frame through N registers. The timing and control unit detector 145B knows how many clock cycles it will take for the return pulse to appear at the output of the chain of drivers, so it knows when to look for it. If the return pulse is detected at the end of the chain, then the timing and control unit detector 145B sets a timing error bit to a value indicative of a PASS. If the return pulse is not detected, the timing and control unit detector 145B sets the timing error bit to a value indicative of a FAIL. The timing error bit, also referred to as the PASS/FAIL bit, is included with the serial data sent back to the video processor 120 via the transmitter 170.

Depending on how the protocol for the serial data is set up, the video processor 120 may look at one serial message for the COP and another serial message for the PASS/FAIL bit. Or, the COP and the PASS/FAIL bit may be sent back to the video processor 120 in the same message.

Referring again to FIG. 1, the video processor includes a comparison 130 that compares a sequence of captured COP data across multiple video frames received from the AMLCD 140 with the encoded COP data that was embedded across the multiple video frames and sent to the AMLCD 140 to determine whether the sequences match. For this purpose, the comparison unit 130 is synchronized, such that the sequence of COPs encoded across multiple video frames is compared to the COPs detected across those same multiple video frames. This synchronization may be achieved using pseudo random binary sequence (PRBS) encoding of the COPs. However, there may also be a counter that increments a count for each digital video frame sent to the AMLCD 140. As long as the comparison unit 130 knows what the value was for the previous frame, then it knows what the value should be for the next frame. Accordingly, the comparison unit 130 is synchronized over multiple video frames, i.e., at least two frames of video. In actual operation there may be a small number of missed or repeated frames due to factors such as clock synchronization or video processing mode changes, and these are preferably filtered appropriately to reduce the occurrence of false failures.

The comparison unit 130 compares a sequence of encoded COPs embedded across multiple video frames sent to the AMLCD 140 with a sequence of detected COPs in the same multiple video frames. If the sequences match, then all is well with the digital video stream and the timing & control circuitry 145. The comparison unit also determines whether the timing error bit is a PASS or a FAIL. If the bit is a PASS, then all is well with the shift registers in the AMLCD (e.g., there are no broken links within the chain of registers). Matching COP sequences and a PASS bit are indicative of a good video system.

Otherwise, the comparison unit 130 cause the flag fault generator 135 to set a fault flag. The fault flag generator 135 outputs the flag fault to a system correction unit 110 in the system front end 100 to initiate a correction action.

In particular, if the sequence of COPs does not match, then either the digital video stream is corrupt or missing. In this case, a flag fault generator 135 sets a flag which is sent to a corrective action unit 110 indicating that the correction action needs to be taken with regard to the video stream, e.g., switching video sources, sending a notification, turning off a backlight, etc. If the sequence of COPs match but the timing bit error is a FAIL, then it is apparent that there is a problem with the shift registers, and a corrective action may be taken to switch to a different (healthy) display.

Figure 3:
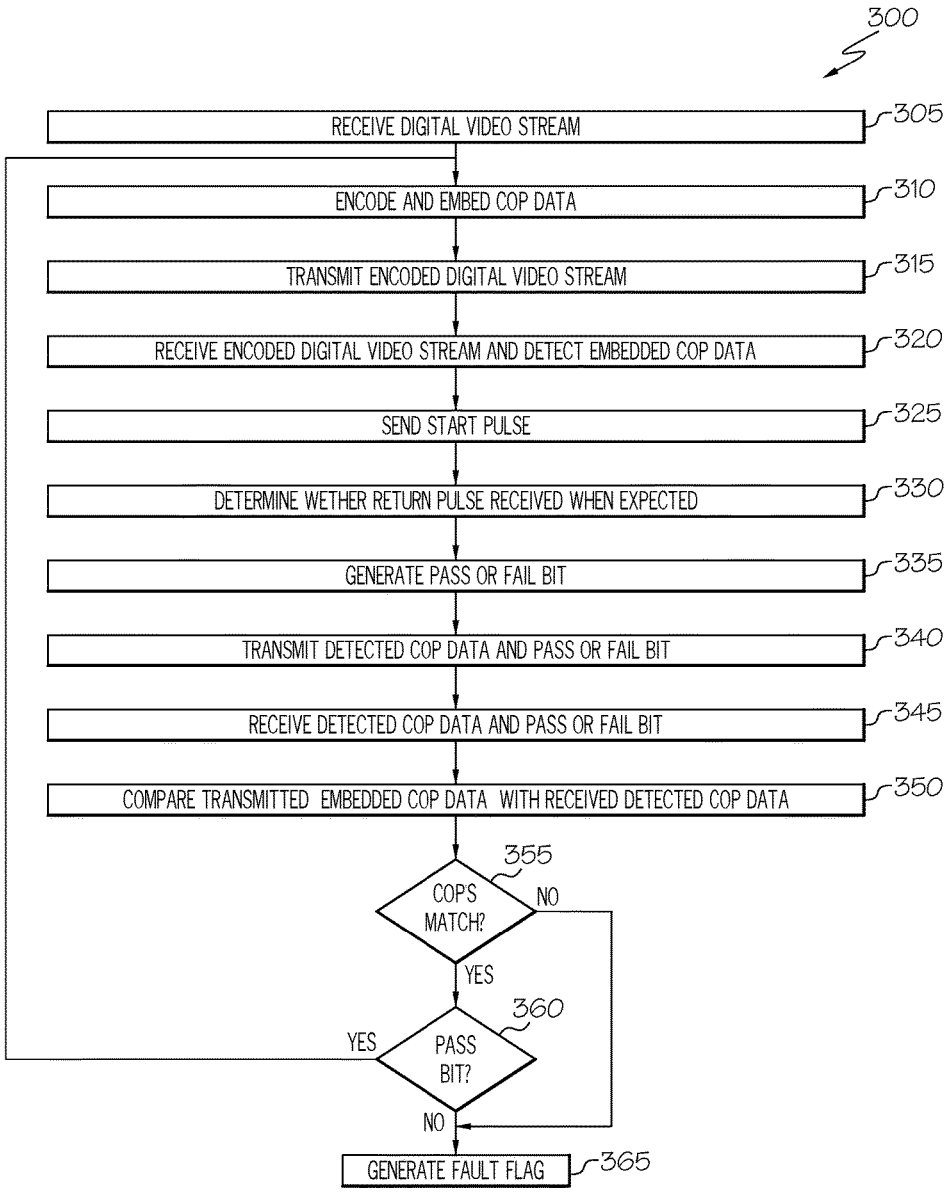
FIG. 3 illustrates a method for fault detection in a display system according to an illustrative embodiment.

FIG. 3 illustrates a method for detecting a fault for a AMLCD according to an illustrative embodiment. It should be understood that the steps or other interactions of the illustrated method are not necessarily presented in any particular order and that performance of some or all the steps in an alternative order is possible and is contemplated. The steps have been presented in the demonstrated order for ease of description and illustration. Steps can be added, omitted and/or performed simultaneously without departing from the scope of the appended claims.

Referring to FIG. 3, the method 300 begins at step 305 at which a digital video stream is received from the front end 100 by the video processor 120. Encoded fault detection data, e.g., a COP, is embedded into the digital video stream at step 310. This encoding/embedding occurs, e.g., in the encoder 125. The digital video stream, with the encoded COP data embedded, is output to the AMLCD 140 at step 315. At step 320, the encoded digital video stream is received, and the fault detection data is captured from the digital video stream. This step may be performed in the timing and control unit 145.

At step 325, the timing and control unit 145 sends a start pulse to the source and gate drivers, e.g., GD 1 and SG 1, which feed the cascaded shift registers of the AMLCD 140. At step 330, the timing and control unit 145 determines whether the return pulse is received from the gate and source driver, e.g., GD N and SG N when expected. At step 335, the timing and control unit 145 generates a PASS bit if the return pulse is received when expected. If the return pulse is not received when expected or is not received at all, the timing control unit 145 generates a FAIL bit.

At step 340, the detected COP data and the PASS/FAIL bit are transmitted to the video processor 120 via the transmitter 170. The detected COP data and the PASS/FAIL bit are received by the video processor at step 345. At step 350, a comparison unit compares the received COP data from the AMLCD 140 with the embedded COP data sent to the AMLCD 140. This comparison occurs on a frame by frame basis in a comparison unit 130. According to an illustrative embodiment, the comparison unit 130 compares a sequence of COPs captured by the AMLCD 140 in consecutive frames to the COPs that were embedded in the same consecutive frames by the encoder 125 to determine whether the captured COPs are the same or within a threshold of similarity as the embedded COPs. Based on the comparison, a determination is made, e.g., by the comparison unit 130, whether the COPs match at step 355.

If the COPs match, e.g., because the captured COP sequence is the same as the embedded sequence of COPs or the difference does not exceed a given threshold, then a determination is made at step 360 whether the received timing error bit from the timing and control unit 145 is a PASS bit. If the bit is a PASS bit, then the process returns to step 310. It should be appreciated that the comparison of COP data and examination of the PASS/FAIL bit may be performed in the reverse order and/or simultaneously.

If the captured COP sequence is not the same or is not within the given threshold of similarity as the embedded sequence of COPs or if the timing error bit is a FAIL bit, a fault flag is generated to be sent to the system front end at step at 365. The system front end performs a corrective action, e.g., switches to a healthy display or a new video source.

While the claimed invention has been shown and described in example forms, it will be apparent to those skilled in the art that the invention is not limited to the embodiments described herein. For example, while an AMLCD is described herein for illustrative purposes, it should be appreciated that the fault detection system may be applicable to other types of displays, e.g., displays that receive video data over a serial interface and internally process the data using a shift register architecture, with the passage of one received data element through the system validating the entire data path. Many modifications, additions, and deletions can be made therein without departing from the spirit and scope of the invention as defined by the following claims.

What is claimed is:

1. A method for detecting a fault in a display system including an active matrix liquid crystal display (AMLCD), comprising:

embedding fault detection data into a portion of a digital video stream that will not be displayed by the AMLCD, the AMLCD comprising:

cascaded source and gate driver shift registers with associated return pulse circuitry; and a return pulse detector unit that detects return pulses from the shift registers;

transmitting the digital video stream, with the embedded fault detection data, to the AMLCD;

receiving detected fault detection data, detected by the AMLCD, from the AMLCD;

comparing the embedded fault detection data with the received detected fault detection data detected by the AMLCD;

receiving, from the return pulse detector, timing error data indicating whether a timing error occurred in the AMLCD, the timing error data generated by a timing and control circuit coupled to the AMLCD; and determining whether there is a fault in the AMLCD or in a path of the digital video stream based on results of the comparison and upon the received timing error data.

2. The method of claim 1, wherein determining whether there is a fault includes detecting a difference between the detected fault detection data and the embedded fault detection data.

3. The method of claim 1, further comprising outputting a signal to initiate corrective action responsive to determining that there is a fault in the AMLCD or in the path of the digital video stream.

4. The method of claim 1, wherein determining whether there is a fault in the display system or the path of the digital video stream includes determining whether there is a difference between the detected fault detection data and the embedded encoded fault detection data which exceeds a threshold.

5. A display system, comprising:

an active matrix liquid crystal display (AMLCD) comprising a carry over pixel (COP) detection unit that detects and returns COP data present within a plurality of digital video frames; and a fault detection system comprising:

an encoder configured to encode and embed fault detection data associated with the detected COP data into a portion of a digital video frame that will not be displayed on the AMLCD, wherein the digital video frame is output, with the embedded encoded fault detection data, to the AMLCD as part of a digital video stream including the plurality of digital video frames; and a comparison unit incorporated within a processor, the comparison unit configured to receive captured fault detection data output by the display system and compare the captured fault detection data with the embedded encoded fault detection data to determine whether there is a difference between the captured fault detection data and the embedded encoded fault detection data, wherein the difference is indicative of a fault in the AMLCD or a path of the digital video frame.

6. The fault detection system of claim 5, wherein the comparison unit outputs a signal to initiate correction action responsive to detecting the difference between the captured fault detection data and the embedded encoded fault detection data.

7. The fault detection system of claim 6, wherein the comparison unit outputs the signal to initiate corrective action responsive to the difference between the captured fault detection data and the embedded encoded fault detection data exceeding a threshold.

8. The fault detection system of claim 5, wherein the encoder embeds a sequence of encoded fault detection data across multiple digital video frames, and the comparison unit detects a difference between a sequence of fault detection data captured across the multiple digital video frames and the embedded sequence of encoded fault detection data.

9. The fault detection system of claim 5, wherein the fault detection data is encoded and embedded, respectively, into each of the plurality of digital video frames, each respectively encoded and embedded fault detection data within respective digital video frames including a respectively unique COP.

10. The fault detection system of claim 9, wherein the encoder uses pseudorandom binary sequence encoding to respectively encode each unique COP.

11. The fault detection system of claim 9, wherein the respectively unique COP is embedded into a blanking interval of at least one of the plurality of digital video frames.

12. The fault detection system of claim 5, wherein the comparison unit also analyzes timing error data received from the display system, wherein the timing error data indicates whether a timing error occurred in the display system.

13. A method for detecting a fault in a display system, comprising:

providing an active matrix liquid crystal display (AMLCD) incorporated within the display system, the AMLCD comprising cascaded source and gate driver shift registers with associated return pulse circuitry and a return pulse detector unit that detects return pulses from the shift registers;

embedding fault detection data into a portion of a digital video stream that will not be displayed by the AMLCD, wherein embedding the fault detection data includes embedding a sequence of fault detection data across multiple consecutive digital video frames of the digital video stream;

transmitting the digital video stream, with the embedded fault detection data, to the AMLCD;

receiving detected fault detection data, detected by the return pulse detector unit of the AMLCD, from the AMLCD;

comparing the embedded fault detection data with the received detected fault detection data detected by the AMLCD; and determining whether there is a fault in the AMLCD or in a path of the digital video stream based on results of the comparison; and wherein:

comparing the embedded fault detection data with the received detected fault detection data includes comparing the sequence of fault detection data embedded across the multiple consecutive digital video frames with a sequence of received detected fault detection data detected across the multiple consecutive digital video frames; and determining whether there is a fault in the display system or the path of the digital video stream includes detecting a difference between the sequence of fault detection data embedded across the multiple consecutive digital video frames and the sequence of received detected fault detection data detected across the multiple consecutive digital video frames.

14. The method of claim 13, wherein determining whether there is a fault includes detecting a difference between the detected fault detection data and the embedded fault detection data.

15. The method of claim 13, further comprising outputting a signal to initiate corrective action responsive to determining that there is a fault in the AMLCD or in the path of the digital video stream.

16. The method of claim 13, wherein determining whether there is a fault in the display system or the path of the digital video stream includes determining whether there is a difference between the detected fault detection data and the embedded encoded fault detection data which exceeds a threshold.

17. A method for detecting a fault in a display system, comprising:

providing an active matrix liquid crystal display (AMLCD) incorporated within the display system, the AMLCD comprising a carry over pixel (COP) detection unit that detects and returns COP data present within a plurality of digital video frames;

embedding fault detection data into a portion of a digital video stream that will not be displayed by the AMLCD;

transmitting the digital video stream, with the embedded fault detection data, to the AMLCD;

receiving detected fault detection data, detected by the AMLCD, from the AMLCD;

comparing the embedded fault detection data with the received detected fault detection data detected by the AMLCD;

determining whether there is a fault in the AMLCD or in a path of the digital video stream based on results of the comparison, wherein:

the digital video stream further comprises the plurality of digital video frames; and the fault detection data is embedded, respectively, into each of the plurality of digital video frames, each respectively encoded and embedded fault detection data within the respective digital video frames including a respectively unique COP.

18. The method of claim 17, wherein determining whether there is a fault includes detecting a difference between the detected fault detection data and the embedded fault detection data.

19. The method of claim 17, further comprising outputting a signal to initiate corrective action responsive to determining that there is a fault in the AMLCD or in the path of the digital video stream.

20. The method of claim 17, wherein determining whether there is a fault in the display system or the path of the digital video stream includes determining whether there is a difference between the detected fault detection data and the embedded encoded fault detection data which exceeds a threshold.

21. The method of claim 17, wherein the COP data is embedded into a blanking interval of at least one of the plurality of digital video frames of the digital video stream.

* * * * *